US007828913B1

(12) United States Patent
Huddleston

(10) Patent No.: US 7,828,913 B1
(45) Date of Patent: Nov. 9, 2010

(54) PERITECTIC, METASTABLE ALLOYS CONTAINING TANTALUM AND NICKEL

(76) Inventor: James B. Huddleston, 3503 Foremast Dr., Galveston, TX (US) 77554

( * ) Notice: Subject to any disclaimer, the term of this patent is extended or adjusted under 35 U.S.C. 154(b) by 594 days.

(21) Appl. No.: 11/196,140

(22) Filed: Aug. 3, 2005

Related U.S. Application Data

(60) Provisional application No. 60/598,570, filed on Aug. 3, 2004.

(51) Int. Cl.
*C22C 19/00* (2006.01)
*C21D 10/00* (2006.01)

(52) U.S. Cl. ..... 148/426; 420/441

(58) Field of Classification Search ..... 148/426
See application file for complete search history.

(56) References Cited

U.S. PATENT DOCUMENTS

| | | | | |
|---|---|---|---|---|
| 3,184,304 | A | 5/1965 | Andes | |
| 4,116,682 | A * | 9/1978 | Polk et al. | 148/403 |
| 4,297,135 | A * | 10/1981 | Giessen et al. | 148/321 |
| 4,582,536 | A * | 4/1986 | Raybould | 75/246 |
| 4,786,468 | A | 11/1988 | Wang et al. | |
| 5,803,992 | A * | 9/1998 | McCallum et al. | 148/302 |
| 6,372,012 | B1 * | 4/2002 | Majagi et al. | 75/236 |

OTHER PUBLICATIONS http://products.asminternational.org/hbk/do/highlight/content/V13a/D04/A01/s0093757.htm Downloaded Sep. 11, 2008 from ASM Handbook, vol. 13A, ASM International, 2003.*

J.W. Mellor, D.Sc., F.R.S.; Inorganic and Theoretical Chemistry; Sep. 1947; pp. 892-895; vol. IX; Longmans, Green and Co., London, New York, Toronto.

* cited by examiner

*Primary Examiner*—George Wyszomierski
*Assistant Examiner*—Tima M McGuthry-Banks
(74) *Attorney, Agent, or Firm*—John Wilson Jones; Jones & Smith, LLP

(57) ABSTRACT

A metastable, peritectic alloy contains nickel in addition to tantalum and, optionally, niobium and/or tungsten. The alloy typically contains between from about 60 to 70 weight percent nickel and between from about 30 to 40 weight percent tantalum. The alloy may be prepared by melting the nickel and tantalum and/or a tantalum-nickel alloy under an inert gas or under a vacuum to a temperature of approximately 1475° C. to about 1550° C. The molten metal is then poured through a ceramic nozzle fitted with gas jets to atomize the molten stream into small droplets. The metastable characteristics of the corrosion resistant alloy are attained due to the rapid solidification of the molten alloy during the atomization process. The metastable alloy may further be used as cermet binder wherein another metal or interstitial alloy is incorporated by communition and/or blending into the alloy. This provides a unique system of materials that will impart even higher oxidation resistance and/or chemical and/or wear resistance than the metastable alloy per se. Surface treatments, such as pulse laser, transferred arc plasma, etc. of the peritectic, metastable alloy further may serve to regenerate a surface containing the alloy which has been exposed to harsh environments.

19 Claims, 2 Drawing Sheets

PERITECTIC, METASTABLE ALLOYS CONTAINING TANTALUM AND NICKEL

This application claims the benefit of U.S. Patent Application Ser. No. 60/598,570, filed on Aug. 3, 2004.

FIELD OF THE INVENTION

NiTa peritectic, metastable alloys may be substituted for tantalum and tantalum based alloys when needed for corrosion resistance and higher oxidation resistant applications in the chemical processing, petrochemical refining and mineral refining industries.

BACKGROUND OF THE INVENTION

Tantalum metal is often used in highly corrosive applications in the petrochemical and mineral ore processing industries. Tantalum is extremely corrosion resistant to most mineral and organic acids, such as sulfuric acid and nitric acid, and gases, such as hydrogen sulfide, as well as caustic environments up to about 175° C. Unfortunately, tantalum is very expensive and dense and further is very difficult to work with due to its high sensitivity to oxidation, high melting point and inherent softness. In light of its high sensitivity to oxidation, very specific environmental measures, including highly inert atmospheres, must be employed in order to fabricate tantalum. In addition to the high expense which must be spent to produce it, tantalum also exhibits low resistance to erosion.

Alternatives to tantalum which provide equivalent or near equivalent corrosion resistance properties are desired.

SUMMARY OF THE INVENTION

A metastable alloy which provides the same or nearly the same corrosion resistance of pure tantalum contains between from about 60 to 70 weight percent nickel and 30 to 40 weight percent tantalum. A portion of the tantalum may be substituted with tungsten and/or niobium. In particular, the alloy may optionally contain up to about 4 weight percent tungsten and/or niobium in order to lower the effective cost of the alloy. The melting point of the alloy is approximately 1400° C.

BRIEF DESCRIPTION OF THE DRAWINGS

In order to more fully understand the drawings referred to in the detailed description of the present invention, a brief description of each drawing is presented, in which.

DETAILED DESCRIPTION OF THE PREFERRED EMBODIMENTS

A metastable, peritectic alloy of the invention contains nickel in addition to tantalum. Alternatively, the alloy may further contain niobium and/or tungsten. The amount of nickel in the alloy is between from about 60 to 70 weight percent. The amount of tantalum in the alloy is between from about 30 to 40 weight percent. In a preferred embodiment, the alloy contains 36 weight percent tantalum and 64 weight percent nickel.

A portion of the tantalum may be substituted with niobium and/or tungsten. Typically, no more than 4 weight percent of the alloy contains niobium and/or tungsten. In a preferred embodiment, the amount of tungsten and/or niobium substituted for the tantalum is no greater than a 1:9 tungsten/niobium:tantalum weight ratio.

The metastable alloy of the invention provides the same or nearly the same corrosion resistance as pure tantalum. The alloy is a highly crystalline solid solution alloy wherein the tantalum does not change or modify the crystalline structure of the nickel phase.

The melting point of the alloy is approximately 1400° C., versus nearly 3000° C. for pure tantalum.

The alloy may be produced by superheating the nickel and tantalum and/or a revert or rejected tantalum-nickel alloy (such as flash, etc.) optionally with niobium and/or tungsten, under an inert gas or under a vacuum to a temperature of approximately 1475° C. to about 1550° C. The resulting molten metal is then permitted to flow through a ceramic nozzle, equipped with gas jets, to atomize the molten stream into small droplets. The gas is typically argon and/or helium. The molten material has sufficient liquidity, prior to flowing through the nozzle, to prevent it from freezing during atomization.

Simultaneously with atomization, the molten metal undergoes solidification as it is cooled at a very rapid rate from 1000° C. to about 10,000° C. per second. The resulting product acquires a metastable structure. After cooling, the resultant powder is collected in a sealed, water jacketed, cooled vessel containing the inert gas(es) to protect the powder from oxidizing.

Figure 1:
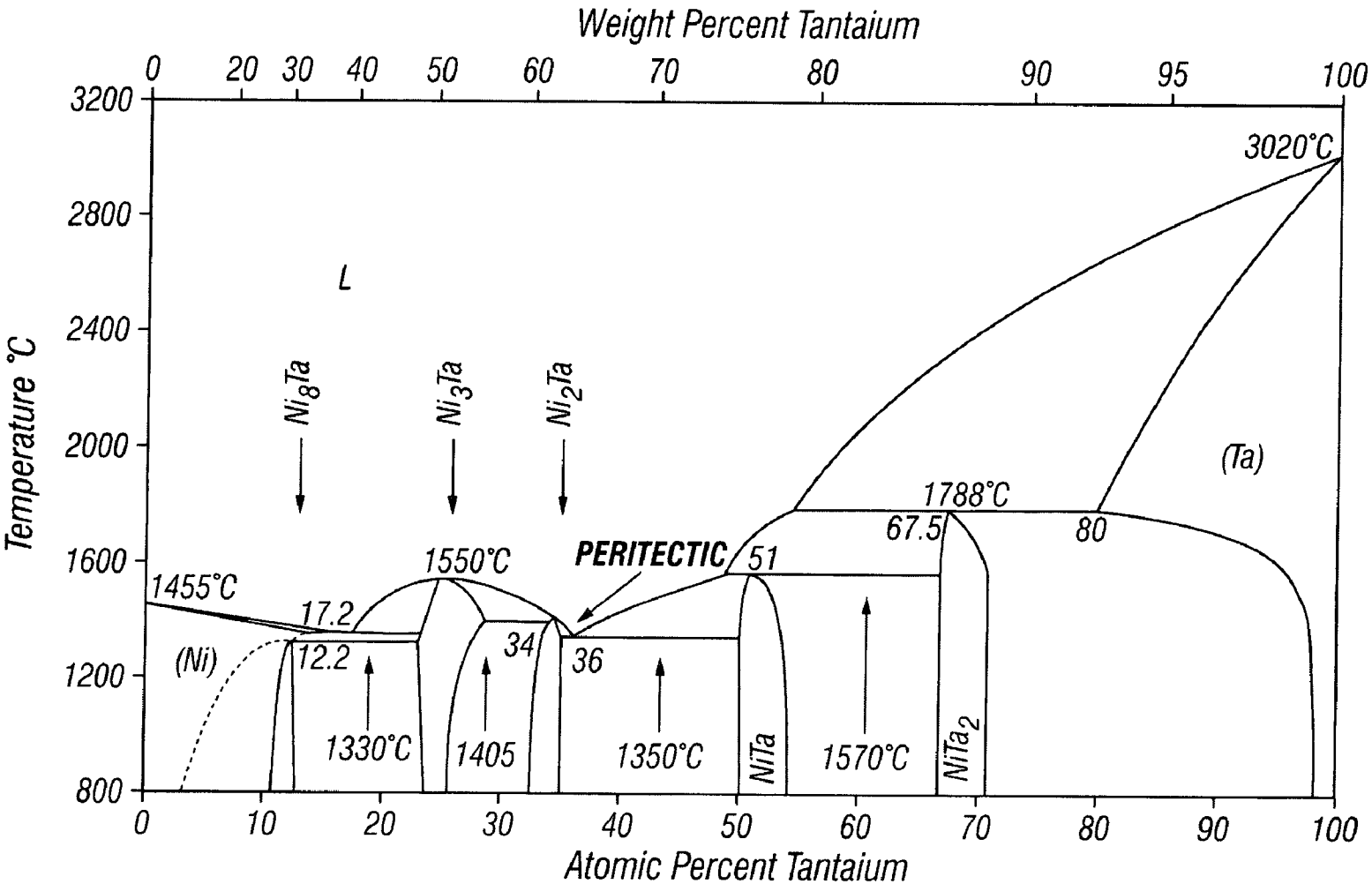
FIG. 1 is a phase diagram illustrating the formation of the metastable peritectic alloy of the invention.

The metastable peritectic alloy is formed in accordance with the phase diagram set forth in FIG. 1. During rapid solidification, the product proceeds through a peritectic phase where the solid and liquid phases form a distinct 100% cubic nickel phase as determined by x-ray diffraction, upon rapid cooling from the molten metal. While the metals may have a propensity to form different crystalline structures, freezing of the metals at the peritectic creates a unique material. The resulting material is a highly crystalline solid solution alloy of two distinct crystalline phases. When viewed by x-ray diffraction (XRD), the product appears as an unrecognizable tantalum phase in a cubic nickel phase. As such, the crystalline structure of the tantalum phase is indistinct from the crystalline structure of the nickel phase much as a matching overlay of tantalum over the nickel phase. As a result, the peaks of tantalum are not displayed on the XRD of the metastable alloy.

The metastable alloy is created by the rapid solidification from a liquid melt that prevents the growth of two different phases of different crystalline structure. It is the rapid solidification which renders the crystalline metastable condition to the resulting alloy. The alloy exhibits unique, high temperature corrosion resistance that is superior to that of the two NiTa phases, NiTa and $Ni_2Ta$. (As used herein, the term metastable shall include the state wherein the two elements co-exist in a single crystal state. The metastable state may be destroyed, and the tantalum migrated out of the cubic nickel phase, by undesirable processing conditions, such as the recrystallization or the addition of a material which causes the phases to separate into two crystalline states. It is the metastable condition of the alloy which provides unique corrosion and thermal resistance properties.)

When exposed to high temperature oxidation, the alloy forms a tightly bonded oxide spinel on its surface to inhibit further oxidation. The alloy has particular applicability in areas exposed to extreme heat (temperatures in excess of 600° C.) and highly corrosive environments, as well as those environments requiring the flow of gases and/or liquids containing solids. The high corrosion resistance of the alloy is attributed to its unique metastable condition resulting from the rapid solidification.

The metastable alloy of the invention may be fabricated into thermal spray powder or powder for powdered metallurgical shapes, such as tubes, plate and other structural shapes for the petrochemical and mining industry for heat exchanges, scrubber linings, fan housing and fan blades, pump impellers and housings, valves, etc. Further, the alloys may be employed as less expensive coatings for applications requiring tantalum overlays such as reaction vessels and pipes leading to such vessels and similar apparatus, such as those exposed to such highly corrosive acids as concentrated nitric or sulfuric acid.

The alloy may be used as a matrix material in the blending of corrosion and erosion resistant materials. Further, it may be micro-alloyed with corrosion and erosion resistant materials, whereby the micro-alloyed materials are in the same structure as they are when added, and not actually solutioned with the NiTa matrix, to provide improved performance which may be tailored to specific applications.

However, when the alloy is used with conventional additives, the blending of such corrosion and erosion resistant materials may not be advantageous because of segregation of the alloy and additives. In many instances, it is important to have extremely homogenous and non-reactive elements exposed at the surface to attain the maximum effect.

In such instances, non-reactive additives are included into the nickel/tantalum alloy without changing the chemical nature of the alloy. Such inclusions serve to avoid alteration and/or degradation of the corrosion resistant characteristics imparted to the alloy. The amount of such non-reactive additives based on the total weight of the alloy is generally between from 0 to about 35 weight percent.

Such non-reactive additives are selected so as not to alter the inherent toughness, resistance to embrittlement and critical coefficient of thermal expansion that complements the substrate and/or fixtures, flanges, supports, etc. to which the alloy is coated. Preferred as non-reactive additives are the metals Cr, Mo, W, V, Zr, Al, etc. and such interstitial alloys as $MoSi_2$, SiC, $Cr_2O_3$, TaC, WC, $TiB_2$, $B_4C$, $Cr_3C_2$ and other oxides, carbides and/or silicides, etc.

Such non-reactive additives may be assimilated in the nickel/tantalum alloy by methods having insufficient energy to cause a reaction between the metastable alloy and the non-reactive additive. Suitable methods include those which ensure non-melting of the non-reactive additive into the metastable alloy, such as laser cladding, welding, etc. Further, a rapid surface treatment may further be required to revert the coating to the desired metastable state.

Cermets containing such non-reactive additives may further be prepared as set forth above wherein the non-reactive additive(s) is injected into the molten pool prior to rapid solidification.

Further, in melted alloy materials resulting from laser or plasma transfer arc (PTA) applied processes, where contamination from the coated substrate may alter the metastable alloy, a very thin nickel interface coating overlay may be required.

Depending on the use of the alloy, the non-reactive additive, for example when employed in cermets, ceramics, etc., may be required to have a thin nickel coating in order to facilitate metallurgical bonding of the non-reactive additive with the metastable alloy and to prevent the migration of the non-reactive additive solid solution into the metastable alloy. Further, such coatings may prevent the metastable alloy from reforming due to the contamination from non-reactive additives.

Figure 2:
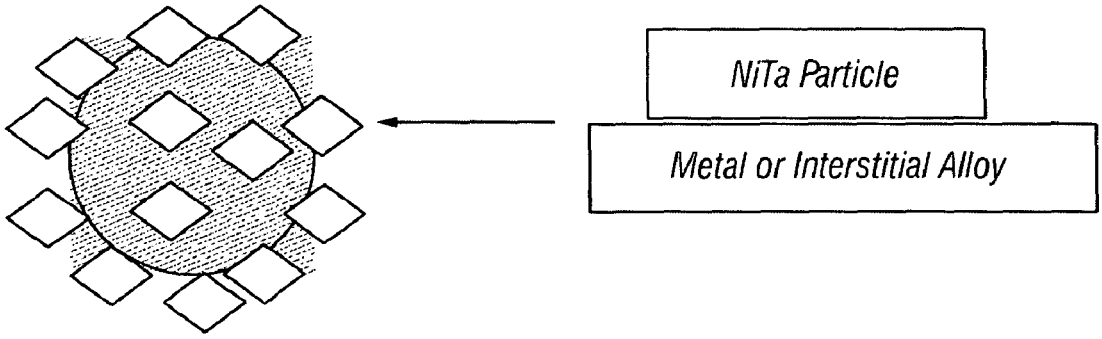
FIG. 2 is a diagram of an embodiment of the invention illustrating the metastable peritectic alloy with a second metal or interstitial alloy.

FIG. 2 illustrates a representative cermet wherein the alloy contains one of the aforementioned metals or metal alloys; the non-reactive material having been comminuted or blended into the peritectic metastable alloy. When the alloy contains such non-reactive materials, the resulting material may exhibit significant improvements in wear resistance and/or "morphs" into a unique surface that provides protection from hostile environments.

Such cermets have particular applicability in reactor vessels, pipings, tubings, pump impellers, shafts and housings, scrubbers, catalyst towers, exhaust fans and housing, valves, etc. for refining, petrochemical and mineral refining.

The peritectic, metastable alloy, with or without the non-reactive metal, may be coated onto a formed (or unformed) substrate. In a preferred embodiment, the alloy is coated onto the substrate by thermal spraying or by laser. For instance, the alloy powder may be sprayed directly onto the substrate or it may be injected into a laser stream and welded onto the substrate by the laser beam.

Further, the peritectic, metastable alloy, during its formation, may be coated directly onto a substrate. Suitable substrates include stainless steel and such metallic surfaces as titanium, copper, etc. In such processes, the preferred mode of application of the alloy onto the substrate is electron beam, transferred arc plasma or pulse laser. Alternatively, the alloy may be converted into its stable state and then reformulated into its metastable condition, by undergoing rapid solidification, while being coated onto a substrate in the presence of the heat source.

The processing of the alloy onto a substrate, as set forth herein, can further be used as a means to densify the coating of alloy or to assist in the incorporation of the non-reactive metal or other compounds into the metastable alloy.

Figure 3:
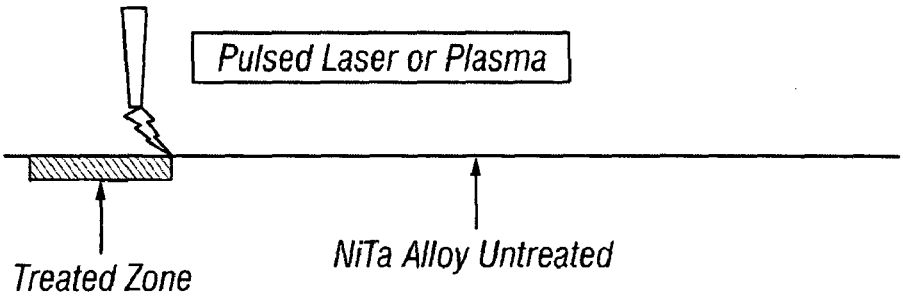
FIG. 3 illustrates the use of pulse laser and/or transferred arc plasma in the coating of the metastable peritectic alloy onto a substrate.

The use of such means to render the coating onto a substrate is illustrated in FIG. 3. Such treatments on surfaces of cast, wrought and or/forged or extruded shapes of the alloy allow greater flexibility in fabrication techniques of the alloy and subsequent rapid solidification surface treatments to achieve the peritectic alloy described and the micro and micro alloying of non-reactive metals.

The surface treatments of the NiTa alloy provide greater operational windows for treating large surface applications such as pipes and tubings, reactor vessels, housings, impellers, fan blades, etc. where the fabrication of the alloy may have compromised the metastable state of the material during fabrication. Surface treatments can be done as an OEM activity or used in the field to regenerate a worn surface to restore it to its effective metastable state.

The following examples will illustrate the practice of the present invention in its preferred embodiments. Other embodiments within the scope of the claims herein will be apparent to one skilled in the art from consideration of the specification and practice of the invention as disclosed herein.

It is intended that the specification, together with the example, be considered exemplary only, with the scope and spirit of the invention being indicated by the claims which follow.

EXAMPLES

All percentages expressed herein are weight percentages, unless otherwise noted.

Example 1

Two 100+ lbs. lots of NiTa metastable alloy were produced by melting in an induction furnace, under an argon blanket, at 1550° C. and argon gas atomized at a freezing rate of 1000 C/sec to a particle size of 10 to 200 microns. Lot No. 1 was pure NiTa of 64.3% Ni, 35.7% Ta and <0.02% C, <0.2% were other components. Lot. No. 2 was altered to examine the impact of common contaminants from melting, exposed atmosphere, and/or diffusion or substrate alloying on the structure and/or chemical resistance of the alloy. The chemical composition of the altered alloy was: 62.6% Ni, 35.8% Ta, 0.2% C, 0.2% Si, 0.2% B, 0.65% Cr, and total others 0.10%.

Powder samples of each lot were examined by X-ray diffraction. (XRD). The parameters of the XRD are the same for all subsequent analyses. Wave lengths: $K\alpha 1$ 1.5405600, $K\alpha 2$, 1.5443900, intensity ratio 0.5000. $K\beta$ 1.3922200.

Comparisons of the XRD patterns of the two powder samples showed a significant shift of the cubic nickel levels and appearance of other, unidentified phases, in NiTa #2. This is indicative of the presence of contaminants of other elements at levels of 1-1.5% on the metastable phase.

Example 2

Corrosion of the NiTa metal powder alloys of Example 1 were compared with reagents commonly used in highly corrosive environments at their respective boiling points (90° C.) at 48 hours exposure. They all were all of the same particle size distribution. The results are set forth in Table I:

TABLE I

| | 8N $HNO_3$ | 15.8N $HNO_3$ | 12N $H_2SO_4$ | 36N $H_2SO_4$ | 6N HCl | 8N NaOH |
|---|---|---|---|---|---|---|
| NiTa #1 | NR | NR | NR | NR | NR | NR |
| NiTa #2 | S | S | S | S | R | NR |
| Ta | NR | NR | NR | NR | NR | S |
| Hastelloy C (Ni based alloy) | NR | NR | S | S | NR | NR |

NR = no reaction
S = slight reaction
R = reaction

The NiTa alloy was very competitive in all corrosive environments except HCl, as compared to other corrosion resistant alloys at atmospheric pressures and a number of corrosive compounds found in the chemical processing industry.

Example 3

Coating and fabrication application techniques for NiTa were explored to determine the preferred means for processing the alloy onto a substrate without affecting the metastable character of the alloy. Such destabilization may result from heating, cooling, contamination conditions etc. as well as the alloy's corrosive and heat instability tendencies in aggressively corrosive atmospheres. XRD analyses of the NiTa material #1 were evaluated. The results of the application techniques and the XRD evaluations versus powder XRD are shown in Table II:

TABLE II

| Process | XRD Analysis |
|---|---|
| Plasma spray | NC |
| Plasma with $Al_2O_3$ inclusions | NC |
| High Velocity OxyFuel (HVOF) thermal spray | NC |
| Laser cladding | PS |
| PTA cladding | PS |

NC = No change
PS = phase shift

Example 4

Thermal spray coatings of the NiTa alloy were performed for the evaluation of hardening by $Al_2O_3$ inclusions at a rate of 10 to 25 weight percent. The $Al_2O_3$ was a fused product with a particle size of 5 to 35 microns, applied by plasma spray. The changes in marcohardness of the coatings, measured by the Diamond Pyramid Hardness (DPH) scale, are set forth in Table III:

TABLE III

| Wt. Percent, $Al_2O_3$ | DPH Hardness | NiTa Phase Change |
|---|---|---|
| 0 | 600 | None |
| 10 | 650 | None |
| 15 | 700 | None |
| 25 | 770 | None |

The use of such inclusions is capable of increasing the hardness level of the alloy without affecting the nickel tantalum phase.

Example 5

Elevated temperature oxidation resistance of the commonly recognized corrosion resistance alloys was performed by Differential Thermal Analysis/Thermal Gravimetric Analysis "DTA/TGA" on the same size powder samples of NiTa, Ta, and Hastelloy C. The results are listed in Table IV below in percent of weight gain from oxidation:

TABLE IV

| | 500° C. | 600° C. | 650° C. | 750° C. | 850° C. | 900° C. | 1000° C. |
|---|---|---|---|---|---|---|---|
| Ni | 0 | 0.2 | 0.3 | 0.5 | 2.5 | 3.5 | 12.5 |
| Ta | 1.3 | 2.5 | 22.1 | Complete oxidation | Complete oxidation | Complete oxidation | Complete oxidation |
| Hastelloy C | 0 | 0.2 | 0.3 | 0.05 | 1.0 | 1.5 | 5.0 |

The foregoing disclosure and description of the invention is illustrative and explanatory thereof, and various changes in the size, shape, and materials, as well as in the details of illustrative construction and assembly, may be made without departing from the spirit of the invention.

What is claimed is:

1. An alloy comprising between:

(a.) from about 60 to about 70 weight percent nickel; and (b.) from about 30 to about 40 weight percent tantalum wherein the alloy is metastable and, when viewed by x-ray diffraction, comprises an unrecognizable tantalum phase in a cubic nickel phase and further wherein the corrosion resistance of the metastable alloy is substantially the same as the corrosion resistance of pure tantalum.

2. The alloy of claim 1, wherein from 0 to about 4 weight percent of the tantalum is substituted with tungsten and/or niobium.

3. The alloy of claim 1, wherein the melting point of the alloy is approximately 1400° C.

4. The alloy of claim 1, further comprising a non-reactive additive.

5. The alloy of claim 4, wherein the non-reactive additive is a metal selected from the group consisting of Cr, Mo, W, V, Zr and Al.

6. The alloy of claim 4, wherein the non-reactive additive is selected from the group consisting of $MoSi_2$, SiC, $Cr_2O_3$, TaC, WC, $TiB_2$, $B_4C$ and $Cr_3C_2$.

7. The alloy of claim 4, wherein the non-reactive additive has a nickel coating.

8. The alloy of claim 1, wherein the alloy contains 36 weight percent tantalum and 64 weight percent nickel.

9. The alloy of claim 2, wherein the amount of tungsten substituted for the tantalum is no greater than a 1:9 weight ratio.

10. The alloy of claim 1, which is prepared by:

(a.) melting nickel and tantalum or a tantalum-nickel alloy and, optionally, tungsten and/or niobium, under an inert gas and under vacuum to a temperature of about 1475° C. to about 1550° C.;

(b.) atomizing the molten metal of step (a.) into droplets;

(c.) rapidly cooling the droplets at the rate of about 1000° C. to about 10,000° C.

11. The alloy of claim 10, wherein the molten metal is atomized in the presence of argon and/or helium.

12. The alloy of claim 10, wherein a non-reactive additive is injected into the molten metal prior to step (c.).

13. The alloy of claim 12, wherein the non-reactive additive is a (i.) metal selected from the group consisting of Cr, Mo, W, V, Zr and Al; or (ii. an alloy selected from the group consisting of $MoSi_2$, SiC, $Cr_2O_3$, TaC, WC, $TiB_2$, $B_4C$ and $Cr_3C_2$.

14. The alloy of claim 10, wherein the alloy contains 36 weight percent tantalum and 64 weight percent nickel.

15. A cermet binder comprising the alloy of claim 4.

16. A composite comprising the alloy of claim 1 coated onto a substrate.

17. The composite of claim 16, wherein the substrate is stainless steel, titanium or copper.

18. A metastable alloy comprising between:

(a.) from about 60 to about 70 weight percent nickel; and (b.) from about 30 to about 40 weight percent tantalum wherein the corrosion resistance of the metastable alloy is substantially the same as the corrosion resistance of pure tantalum molten metal and further wherein the crystalline structure of the tantalum phase of the metastable alloy is indistinct from the cubic crystalline structure of the nickel phase such that, when viewed by x-ray diffraction, tantalum is unrecognizable and further wherein the alloy is prepared by:

(a.) melting nickel and tantalum or a tantalum-nickel alloy under an inert gas and under vacuum to a temperature of about 1475° C. to about 1550° C.;

(b.) atomizing the molten metal of step (a.) into droplets;

(c.) rapidly cooling the droplets at the rate of about 1000° C. to about 10,000° C.

19. An alloy consisting essentially of between:

(a.) from about 60 to about 70 weight percent nickel; and (b.) from about 30 to about 40 weight percent tantalum wherein the alloy is (i) metastable, (ii) the amount of carbon in the alloy does not exceed 0.2 weight percent and the amount of boron in the alloy does not exceed 0.2 weight percent and (iii) when viewed by x-ray diffraction, the alloy comprises an unrecognizable tantalum phase in a cubic nickel phase and further wherein the corrosion resistance of the metastable alloy is substantially the same as the corrosion resistance of pure tantalum.

* * * * *